US011092915B2

(12) United States Patent
Hatazaki

(10) Patent No.: US 11,092,915 B2
(45) Date of Patent: Aug. 17, 2021

(54) COOLING DEVICE, IMAGE FORMING APPARATUS AND IMAGE FORMING SYSTEM

(71) Applicant: CANON KABUSHIKI KAISHA, Tokyo (JP)

(72) Inventor: Kazunari Hatazaki, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/896,724

(22) Filed: Jun. 9, 2020

(65) Prior Publication Data

US 2020/0387093 A1 Dec. 10, 2020

(30) Foreign Application Priority Data

Jun. 10, 2019 (JP) ..... JP2019-107674

(51) Int. Cl.
*G03G 15/14* (2006.01)
*G03G 15/20* (2006.01)

(52) U.S. Cl.
CPC ..... *G03G 15/2021* (2013.01); *G03G 15/2025* (2013.01)

(58) Field of Classification Search
CPC ..... G03G 15/2017; G03G 15/2021; G03G 15/2025; G03G 21/206; G03G 2221/1645
USPC ..... 399/91, 94, 341, 390, 407
See application file for complete search history.

(56) References Cited

U.S. PATENT DOCUMENTS

| | | | | |
|---|---|---|---|---|
| 8,929,794 | B2 | 1/2015 | Hatazaki | 399/341 |
| 9,046,858 | B2 * | 6/2015 | Ikeda | G03G 15/6573 |
| 9,075,355 | B2 | 7/2015 | Chiyoda et al. | G03G 15/2025 |
| 9,207,602 | B2 | 12/2015 | Hatazaki | G03G 15/2064 |
| 9,217,964 | B2 | 12/2015 | Hatazaki | G03G 15/2025 |
| 9,310,723 | B2 | 4/2016 | Hatazaki | G03G 15/2025 |
| 9,329,534 | B2 | 5/2016 | Hatazaki | G03G 15/2025 |
| 9,335,676 | B2 * | 5/2016 | Miyagawa | G03G 15/2021 |
| 9,454,111 | B2 | 9/2016 | Hatazaki | G03G 15/2025 |
| 2012/0177425 | A1 | 7/2012 | Shirai et al. | |
| 2020/0285193 | A1 | 9/2020 | Hatazaki | G03G 15/6573 |
| 2020/0387092 | A1 | 12/2020 | Hatazaki | G03G 15/2021 |

FOREIGN PATENT DOCUMENTS

| | | | |
|---|---|---|---|
| JP | H09-80923 | A | 3/1997 |
| JP | 2007-293028 | A | 11/2007 |
| JP | 2009-181055 | A | 8/2009 |
| JP | 2011-121673 | A | 6/2011 |
| JP | 2012-145676 | A | 8/2012 |

OTHER PUBLICATIONS

U.S. Appl. No. 16/951,315, filed Nov. 18, 2020.

* cited by examiner

*Primary Examiner* — Hoan H Tran
(74) *Attorney, Agent, or Firm* — Venable LLP

(57) ABSTRACT

A cooling device for cooling a recording material on which a toner image is fixed includes: a rotatable feeding belt configured to feed the recording material by rotation; a rotatable member configured to nip and feed the recording material in cooperation with the feeding belt; and a heat sink contacting an inner peripheral surface of the feeding belt. The feeding belt contains a fluorine-containing resin additive.

12 Claims, 9 Drawing Sheets

COOLING DEVICE, IMAGE FORMING APPARATUS AND IMAGE FORMING SYSTEM

FIELD OF THE INVENTION AND RELATED ART

The present invention relates to a cooling device for cooling a recording material after a toner image transferred on the recording material is fixed by heating in an image forming apparatus of an electrophotographic type or an electrostatic recording type, and relates to the image forming apparatus and an image forming system which include the cooling device.

Conventionally, in the image forming apparatus using the electrophotographic type, an electrostatic latent image formed on a photosensitive drum as an image bearing member is developed with toner by a developing device, so that a toner image is formed and this toner image is transferred onto a recording material (sheet) and then is fixed on the recording material in a fixing device. The fixing device includes, for example, a rotatable heating member such as a fixing film and a rotatable pressing member such as a pressing roller, and form a fixing nip therebetween and fixes the unfixed toner image on the recording material by heating and pressing the recording material in the fixing nip.

In such an image forming apparatus, the toner (image) is fixed on the sheet (recording material) at a high temperature by applying heat to the sheet in the fixing device, and therefore, when the sheets are stacked on a (sheet) discharge tray while the toner is kept at a high temperature as it is, there is a possibility that the sheets stick to each other by the toner. In order to prevent such sticking of the sheets during stacking, an image forming apparatus including a cooling device provided with fan for cooling the sheet in a feeding passage after fixing has been known. However, with progress of an increase in image forming speed of the image forming apparatus, when a feeding speed is increased, a time for cooling the sheet in the feeding path after the fixing is shortened, so that the sheet could not be sufficiently cooled by only air blowing with the fan. Therefore, in order to enhance a cooling effect, a cooling device in which not only the sheet after the fixing is nipped and fed by feeding belts provided on upper and lower sides but also a heat sink is provided on an inner peripheral side of an upper-side feeding belt has been developed (Japanese Laid-Open Patent Application (JP-A) 2009-181055). In this cooling device, an inner peripheral surface of the upper-side feeding belt and the heat sink are contacted to each other and the upper-side feeding belt is cooled, and the sheet is cooled by being nipped and fed by the upper and lower feeding belts.

However, in the cooling device disclosed in JP-A 2009-181055, the feeding belt rotates in a state of the contact between the feeding belt and the heat sink, so that there is a liability that the feeding belt and the heat sink slide with each other and thus the inner peripheral surface of the feeding belt or a sliding surface of the heat sink is abraded by abrasion (wearing). Further, when abrasion powder generated by the abrasion of the feeding belt or the heat sink is deposited on the sliding surface between the feeding belt and the heat sink, a heat resistance between the heat sink and the sheet increases, so that a cooling performance is lowered thereby.

SUMMARY OF THE INVENTION

A principal object of the present invention is to provide a cooling device capable of suppressing a lowering in cooling performance due to deposition of abrasion powder of a heat sink or a feeding belt on a sliding surface between a heat sink or a feeding belt.

Another object of the present invention is to provide an image forming apparatus including the cooling device and an image forming system including the cooling device.

According to an aspect of the present invention, there is provided a cooling device for cooling a recording material on which a toner image is fixed, the cooling device comprising: a rotatable feeding belt configured to feed the recording material by rotation; a rotatable member configured to nip and feed the recording material in cooperation with the feeding belt; and a heat sink contacting an inner peripheral surface of the feeding belt, wherein the feeding belt contains a fluorine-containing resin additive.

According to another aspect of the present invention, there is provided an image forming apparatus comprising: an image forming portion configured to form a toner image on a recording material; a fixing device including a heating member and a feeding member configured to nip and feed the recording material in cooperation with the heating member and configured to fix the toner image on the recording material by the heating member and the feeding member; and the above-described cooling device provided on a side downstream of the fixing device with respect to a recording material feeding direction.

According to a further aspect of the present invention, there is provided an image forming system comprising: an image forming portion configured to form a toner image on a recording material; a fixing device including a heating member and a feeding member configured to nip and feed the recording material in cooperation with the heating member and configured to fix the toner image on the recording material by the heating member and the feeding member; and the above-described cooling device provided on a side downstream of the fixing device with respect to a recording material feeding direction.

Further features of the present invention will become apparent from the following description of exemplary embodiments with reference to the attached drawings.

DESCRIPTION OF EMBODIMENTS

First Embodiment

In the following, a first embodiment of the present invention will be specifically described with reference to FIGS.

1-3. In this embodiment, as an example of an image forming apparatus 1, a full-color printer of a tandem type is described. However, the present invention is not limited to the image forming apparatus 1 of the tandem type in which a cooling device is mounted, but may also be an image forming apparatus of another type in which the fixing cooling device is mounted. The image forming apparatus 1 is not limited to the full-color image forming apparatus, but may also be a monochromatic image forming apparatus or a single-color image forming apparatus. Or, the present invention can be carried out in various uses such as printers, various printing machines, copying machines, facsimile machines and multi-function machines.

Figure 1:
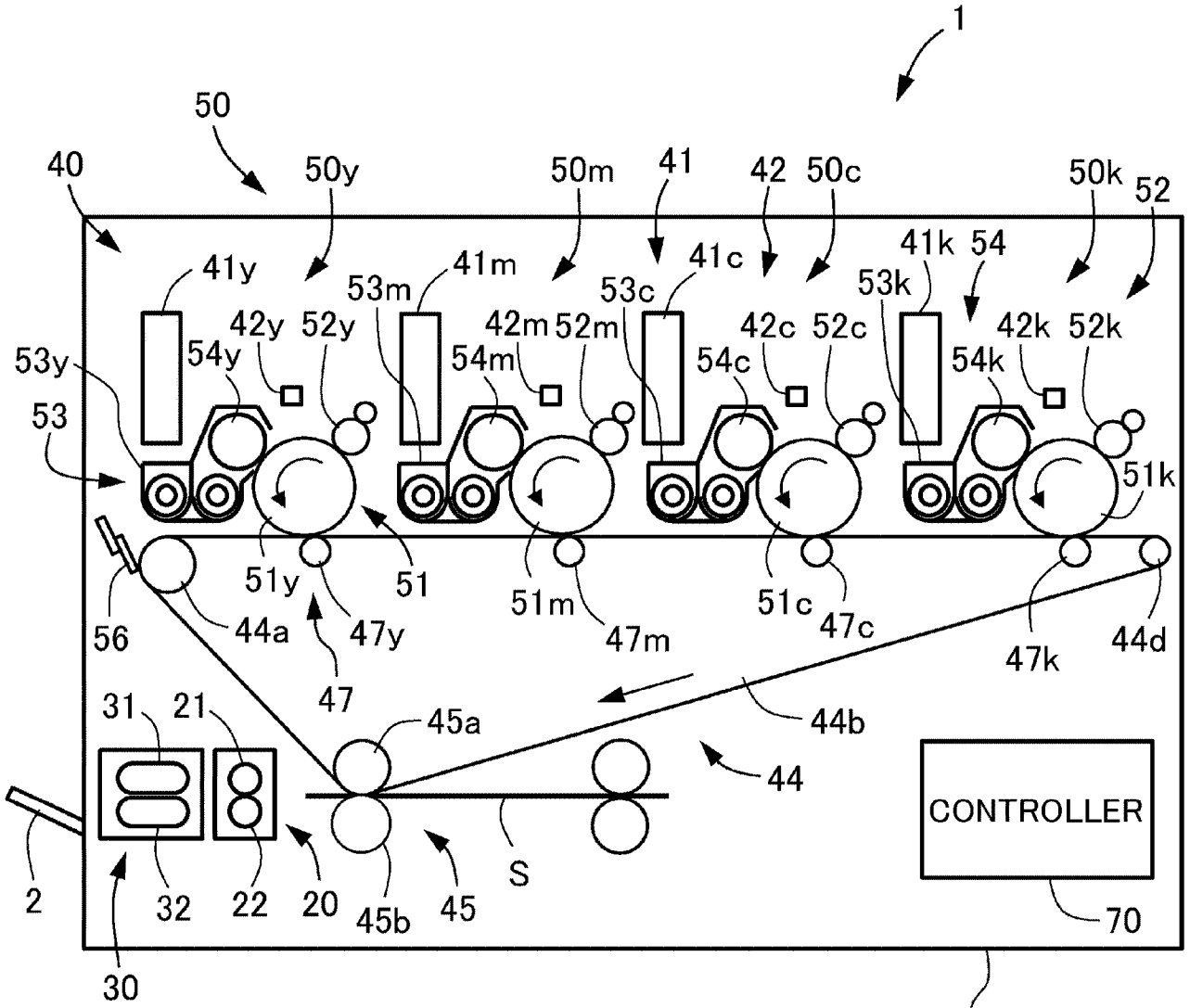
FIG. 1 is a sectional view showing a schematic structure of an image forming apparatus according to a first embodiment of the present invention.

As shown in FIG. 1, the image forming apparatus 1 includes an apparatus main assembly 10, an unshown sheet feeding portion, an image forming portion 40, a fixing device 20, a cooling device 30 for cooling a sheet S, and a controller 70. The image forming apparatus 1 is capable of forming a four-color-based full-color image on a recording material depending on an image signal from an unshown host device such as an original reading device or a personal computer or from an unshown external device such as a digital camera or a smartphone. Incidentally, on the sheet S which is the recording material, a toner image is to be formed, and specific examples of the sheet S include plain paper, a synthetic resin sheet as a substitute for the plain paper, thick paper, a sheet for an overhead projector, and the like.

[Image Forming Portion]

The image forming portion 40 is capable of forming an image as an unfixed toner image, on the basis of image information on the sheet S fed from the sheet feeding portion. The image forming portion 40 includes image forming units 50*y*, 50*m*, 50*c* and 50*k*, toner bottles 41*y*, 41*m*, 41*c* and 41*k*, exposure devices 42*y*, 42*m*, 42*c* and 42*k*, an intermediary transfer unit 44, and a secondary transfer portion 45. Incidentally, the image forming apparatus 1 of this embodiment is capable of forming a full-color image and includes the image forming units 50*y* for yellow (y), 50*m* for magenta (m), 50*c* for cyan (c) and 50*k* for black (k), which have the same constitution and which are provided separately. For this reason, in FIG. 1, respective constituent elements for four colors are shown by adding associated color identifiers to associated reference numerals, but in the specification, the constituent elements are described using only the reference numerals without adding the color identifies in some cases.

The image forming unit 50 includes a photosensitive drum 51 movable while carrying a toner image, a charging roller 52, a developing device 53 and an unshown cleaning blade.

The image forming unit 50 is integrally assembled into a unit as a process cartridge and is constituted so as to be mountable in and dismountable from the apparatus main assembly 10, so that the image forming unit 50 forms the toner image on an intermediary transfer belt 44*b* described later.

The photosensitive drum 51 is rotatable and carries an electrostatic latent image used for image formation. In this embodiment, the photosensitive drum 51 is a negatively chargeable organic photoconductor (OPC) of 30 mm in outer diameter and is rotationally driven at a predetermined process speed (peripheral speed) in an arrow direction by an unshown motor. As each of the charging rollers 52*y*, 52*m*, 52*c* and 52*k*, a rubber roller rotated by the photosensitive drum 51 in contact with a surface of the photosensitive drum 51 is used and electrically charges the surface of the photosensitive drum 51 uniformly. The exposure device 42 is a laser scanner and emits laser light in accordance with image information of separated color outputted from the controller 70. When an image forming operation is started, the photosensitive drum 51 is rotated and a surface thereof is electrically charged by the charging roller 52. Then, the laser light is emitted from the exposure device 42 to the photosensitive drum 51 on the basis of image information, so that the electrostatic latent image is formed on the surface of the photosensitive drum 51.

The developing devices 53*y*, 53*m*, 53*c* and 53*k* include developing sleeves 54*y*, 54*m*, 54*c* and 54*k*, respectively, and each of the developing devices 53 develops, with toner, the electrostatic latent image formed on the associated photosensitive drum 51 by applying thereto a developing bias. The developing device 53 not only accommodates the developer supplied from a toner bottle 41 but also develops and visualizes the electrostatic latent image formed on the photosensitive drum 51. The developing sleeve 54 carries a developer including non-magnetic toner and a magnetic carrier and feeds the developer to a developing region opposing the photosensitive drum 51.

The toner image formed on the surface of the photosensitive drum 51 is primary-transferred onto the intermediary transfer unit 44. After the primary transfer, the toner remaining on the photosensitive drum 51 without being transferred onto the intermediary transfer unit 44 is removed by the cleaning blade provided in contact with the photosensitive drum 51, and then the photosensitive drum 51 prepares for a subsequent image forming process.

The intermediary transfer unit 44 includes a plurality of rollers including a driving roller 44*a*, a follower roller 44*d* and the primary transfer rollers 47*y*, 47*m*, 47*c* and 47*k* and includes the intermediary transfer belt 44*b* wound around these rollers and moving while carrying the toner images. The follower roller 44*d* is a tension roller for controlling tension of the intermediary transfer belt 44*b* at a certain level. The primary transfer rollers 47*y*, 47*m*, 47*c* and 47*k* are disposed opposed to the photosensitive drums 51*y*, 51*m*, 51*c* and 51*k*, respectively, and contact the intermediary transfer belt 44*b*, so that the primary transfer rollers 47 primary-transfer the toner images from the photosensitive drums 51 onto the intermediary transfer belt 44*b*.

The intermediary transfer belt 44*b* contacts the photosensitive drum 51 and forms a primary transfer portion between itself and the photosensitive drum 51, and primary-transfers the toner image, formed on the photosensitive drum 51, at the primary transfer portion by being supplied with a primary transfer bias. By applying a positive primary transfer bias to the intermediary transfer belt 44*b* through the primary transfer rollers 47, negative toner images on the photosensitive drums 51 are multiple-transferred successively onto the intermediary transfer belt 44*b*. The intermediary transfer belt 44*b* is provided with a belt cleaning device 56 for removing transfer residual toner on the intermediary transfer belt 44*b*.

The secondary transfer portion 45 includes an inner secondary transfer roller 45*a* and an outer secondary transfer roller 45*b*. The outer secondary transfer roller 45*b* contacts the intermediary transfer belt 44*b*, and in a nip between itself and the intermediary transfer belt 44*b*, a secondary transfer bias of an opposite polarity to the charge polarity of the toner is applied to the outer secondary transfer roller 45*b*. The sheet S is supplied in parallel to the image forming operation and is timed to the toner images on the intermediary transfer belt 44*b*, so that the sheet S is fed to the secondary transfer portion 45 along the feeding passage. As a result, the outer secondary transfer roller 45*b*, collectively secondary-transfers the toner images from the intermediary transfer belt 44*b* onto the sheet S supplied to the nip.

The fixing device 20 includes a fixing roller 21 and a pressing roller 22, and heats the toner images formed on the sheet S and thus fixes the toner images on the sheet S. Here, the fixing roller 21 is a heating roller heated by a heating source such as a heater. Further, the pressing roller 22 is a pressing roller for pressing the sheet S toward the fixing roller 21 at a predetermined pressure. Further, the sheet S is fed in a sheet feeding direction in a state in which the sheet S is nipped by the fixing roller 21 and the pressing roller 22, whereby the toner images formed by the image forming portion 40 and transferred on the sheet S are heated and pressed and thus fixed on the sheet S. The sheet S heated by the fixing device 20 and is fed to the cooling device 30.

The cooling device 30 cools the sheet S after the toner images are fixed by the heating with the fixing device 20. That is, the cooling device 30 cools the sheet S in a state in which a temperature of the sheet S heated by the fixing device 20 is high. The sheet S cooled by the cooling device 30 is discharged from the cooling device 30 and then is discharged to an outside of the image forming apparatus 1 by an unshown sheet discharging portion, and is stacked on a stacking tray (stacking portion) 2. For example, the sheet S discharged from the cooling device 30 is discharged and stacked on the stacking tray 2 provided outside the image forming apparatus 1. Further, the sheet S is discharged and stacked on a stacking tray provided on a sheet processing device for subjecting the sheet S, on which the image is formed, so stapling (staple processing). Thus, a constitution in which an image forming system in which the sheet processing device is connected to the image forming apparatus 1 includes the cooling device 30 may also be employed.

That is, the sheet S is discharged after passes through the fixing device 30 and then is cooled by the cooling device 30. Incidentally, in the case where images are formed on double (both) sides of the sheet S, the sheet S is turned upside down by being reversed at an unshown reversing portion, and image formation and fixing on a second side (surface) of the sheet S are ended and then the sheet S is cooled by the cooling device 30. The cooling device 30 is driven by the driving motor M1 (FIG. 2) incorporated in the apparatus main assembly 10. Incidentally, cooling by the cooling device 30 means that the temperature of the sheet S discharged from the fixing device 20 is lowered.

[Controller]

Figure 2:
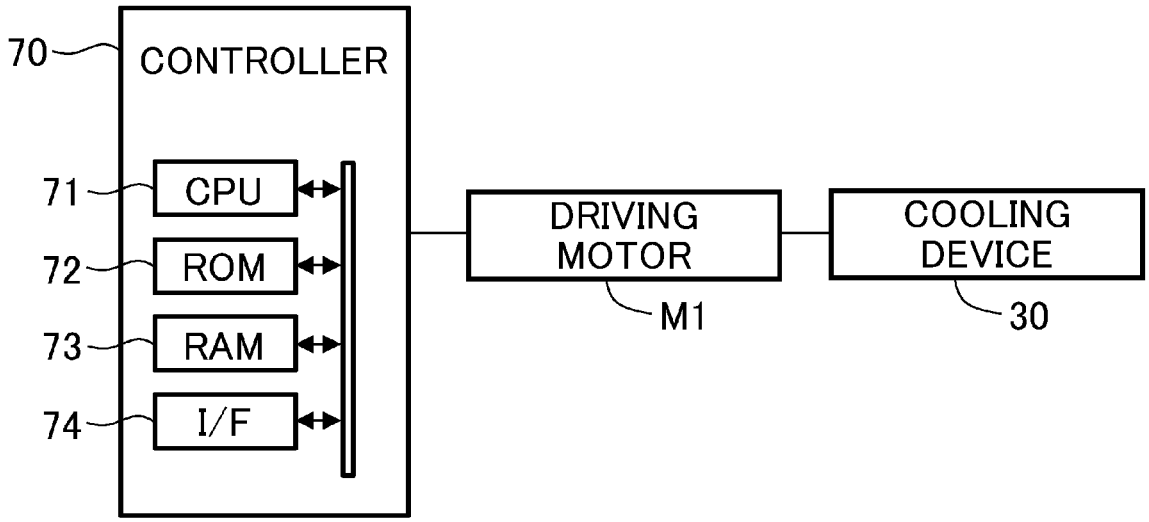
FIG. 2 is a schematic control block diagram of the image forming apparatus according to the first embodiment.

As shown in FIG. 2, the controller 70 is constituted by a computer and includes, for example, a CPU 71, a ROM 72 for storing a program for controlling the respective portions, a RAM 73 for temporarily storing data, and an input/output circuit (I/F) 74 through which signals are inputted from and outputted into an external device. The CPU 71 is a microprocessor for managing an entirety of control of the image forming apparatus 1 and is a main body of a system controller. The CPU 71 is connected with an operating portion, the sheet feeding portion, the image forming portion 40 and the like via the input/output circuit 74 and not only transfers signals with the respective portions but also controls operations of the respective portions. To the controller 70, a driving motor M1 for the cooling device 30 is connected, so that an operation of the cooling device 30 can be controlled. In the ROM 72, an image forming control sequence for forming the image on the sheet S and the like are stored.

[Cooling Device]

Figure 3:
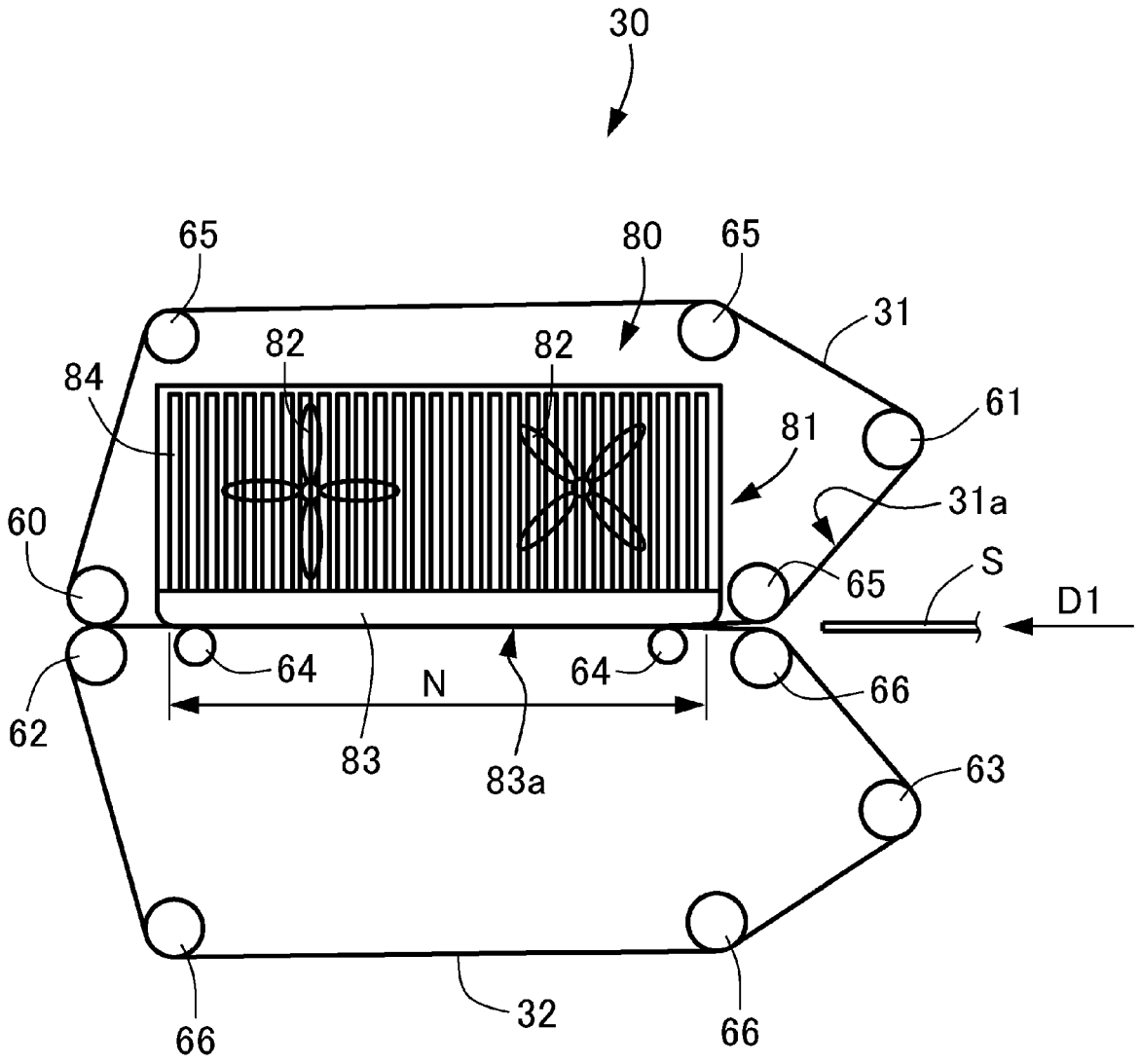
FIG. 3 is a side view showing a cooling device according to the first embodiment.

Next, the cooling device 30 will be described in detail with reference to FIG. 3. As shown in FIG. 3, the cooling device 30 includes an upper belt (feeding belt) 31, a lower belt (recording material member) 32 and a cooling portion 80. Incidentally, in this embodiment, the lower belt 32 is used as the rotatable member, but the present invention is not limited thereto, and the rotatable member may also be a rotatable roller if the roller is capable of nipping and feeding the sheet S in cooperation with the upper belt.

[Belt]

Each of the upper belt 31 and the lower belt 32 comprises a rotatable belt which has an endless shape and flexibility with respect to a rotational direction (feeding direction) and is made of polyimide having strength, and is set at 100 μm in thickness and 942 mm in peripheral length. The upper belt 31 and the lower belt 32 contact each other and form a nip N in which the sheet S put in a state in which the sheet S is heated by being passed through the fixing device 20 is cooled by being nipped and fed. In this embodiment, the nip N is formed with an appropriate length with respect to a sheet fixing device direction D1. That is, the upper belt 31 is provided rotatably by transmitting thereto a driving force from the driving motor M1 by a constitution described later. Further, the lower belt 32 forms the nip N between itself and the upper belt 31, and is provided rotatably together with the upper belt 31, and nips and feeds the sheet S in the nip N by rotation thereof. Further, in this embodiment, the toner images are fixed on the sheet S by heating, and the upper belt 31 contacts a surface of the sheet S on a side where the toner images are fixed. That is, with respect to a thickness direction of the sheet S fed along the feeding passage, on the same side (upper side in this embodiment) as the fixing roller 21, the upper belt 31 including a cooling portion 80 is disposed inside the cooling device 30. By this, the surface of the sheet S on which the toner image in a high temperature state is placed is cooled by the upper belt 31 side higher in cooling efficiency by the cooling portion 80 of the cooling device 30, and therefore the sheet S and the toner on the sheet S can be cooled more efficiently. However, the cooling by the cooling portion 80 is not limited thereto, and the lower belt 32 is also cooled by the cooling portion 80 through the upper belt 31, and therefore, the lower belt 32 may also contact the surface of the sheet S on which the toner image is fixed.

The upper belt 31 is stretched and rotatably supported by a driving roller 60 for driving the upper belt 31, a steering roller 61 for controlling a shift of the upper belt 31 and an idler roller 65. The lower belt 32 is stretched and rotatably supported by a driving roller 62 for driving the lower belt 32, a steering roller 63 for controlling a shift of the lower belt 32 and an idler roller 66.

Each of the driving rollers 60 and 62 is 40 mm in outer diameter and includes a 1 mm-thick rubber layer as a surface layer. The driving roller 60 is fixedly provided with respect to a radial direction. The driving roller 62 is provided so as to press the driving roller 60 at about 49 N (about 5 kgf) by an unshown urging spring. The driving rollers 60 and 62 are connected to the driving motor M1 (FIG. 2) through unshown driving gears, and drive the belts 31 and 32, respectively by rotation of the driving motor M1. Incidentally, a dimension and a structure of the driving rollers 60 and 62 are not limited to those in this embodiment.

Each of the steering rollers 61 and 63 is 40 mm in outer diameter and includes a 1 mm-thick rubber layer as a surface layer. The steering rollers 61 and 63 are urged against the belts 31 and 32, respectively, by unshown urging springs, and are provided so that a tension of each of the belts 31 and 32 is about 39.2 N (about 4 kgf). The steering rollers 61 and 63 are capable of adjusting meandering of the belts 31 and 32 by forming a rubber angle with longitudinal central portions thereof as rotation fulcrums. Incidentally, a dimension and a structure of the steering rollers 61 and 63 are not limited to those in this embodiment.

On an inner peripheral side of the lower belt 32, pressing rollers 64 and 64 are provided at an upstream portion and a downstream portion of the nip N with respect to the sheet feeding direction D1 in order to press a heat receiving surface 83*a* of a heat sink 81 described later. The pressing rollers 64 and 64 urge the belts 31 and 32 each with a force of about 9.8 N (about 1 kgf) and thus press the belts 31 and 32 so as to intimate contact the heat sink 81.

[Cooling Portion]

The cooling portion 80 includes a fan 82 capable of blowing air to the heat sink 81 contacting the inner peripheral surface 31*a* of the upper belt 31. The heat sink 81 includes a base 83 made of, for example, metal such as aluminum in this embodiment and includes fins (heat dissipating portion) 84. The base 83 has a plate shape of 10 mm in thickness and includes, as a lower surfaces, the heat receiving surface (sliding surface) 83*a* slidable on the inner peripheral surface 31*a* of the upper belt 31 in contact with the inner peripheral surface 31*a*. On an upper surface of the base 83, a plurality of fins 84 arranged in the sheet feeding direction D1 are integrally provided with the base 83 with a thickness of 1 mm, a height of 100 mm and a pitch of 5 mm so as to obtain a contact area with the air blown by the fan 82. The heat of the upper belt 31 conducted from the sheet S fed to the nip N is conducted from the heat receiving surface 83*a* to the base 83 and then is conducted from the base 83 to the fins 84, and is discharged from the fins 84 into the air. By this, the sheet S nipped and fed in the nip N is cooled through the upper belt 31 by the heat sink 81 disposed on the inner peripheral side of the upper belt 31. Further, the belts 31 and 32 and the heat sink 81 are pressed and intimately contacted to each other by the pressing rollers 64 and 64, so that a contact area of the heat sink 81 with the belts 31 and 32 becomes sufficiently large. By this, the heat of the sheet S nipped in the nip N by the belts 31 and 32 is efficiently conducted to the heat sink 81 through the upper belt 31.

The fan 82 is provided so as to cool the fins 84 by slowing the air toward the fins 84. In this embodiment, two fans 82 are provided and arranged in the sheet feeding direction D1 and are disposed so as to blow the air in a widthwise direction (left-right direction) perpendicular to the sheet feeding direction D1. Here, when the sheet feeding direction D1 is the widthwise direction (left-right direction) of the image forming apparatus 1, the fans 82 are disposed on a rear side of the image forming apparatus 1 with respect to a front-rear direction and on the rear side than the heat sink 81. Further, the fans 82 rotate so as to such the air relative to the heat sink 81. By this constitution, in a direction perpendicular to the arrangement direction of the fins 84 and the vertical direction, an air flow is formed between the respective fins 84. That is, the fans 82 rotate so that the air flows from the front side toward the rear side of the image forming apparatus 1 between the respective fins 84, and thus cools the heat sink 81. Further, an air blowing rate from the single fan 82 to the fins 84 is 2 $m^3$/min, for example.

For example, a temperature of the sheet S heated by the fixing device 20 is about 90° C. immediately in front of a portion when the sheet S is to be fed to the cooling device 30 and the sheet S is cooled to about 60° C. by being passed through the cooling device 30. On the sheet S, the toner image fixed by the fixing device 20 is placed, and a temperature of the toner on the sheet S immediately before the sheet S is fed to the cooling device 30 is also about 90° C. similarly as the sheet S, so that the toner is cooled to about 60° C. by passing the sheet S through the cooling device 30.

Here, it is assumed that a glass transition point (temperature) of the toner fixed on the sheet S is 70° C. In this case, in a constitution in which the cooling device 30 is not provided, the sheet S of about 90° C. in temperature discharged from the fixing device 20 is to be stacked on a stacking tray 2 provided to the image forming apparatus 1 in a state in which the temperature thereof is the glass transition temperature or more. Thus, when the toner with the temperature which is the glass transition temperature or more is very soft, so that the toner sticks the sheets S together in some cases when the toner is heated and pressed. Specifically, when the sheets S on which the toner of the glass transition temperature or more in temperature is placed are stacked on the stacking tray 2, the sheets S stack to each other in some instances by pressure applied thereto by being stacked and by heat accumulated in the stacked sheets S.

Therefore, in this embodiment, by providing the cooling device 30 on a side downstream of the fixing device 20 with respect to the sheet feeding direction, the sheet S discharged from the fixing device 20 is cooled. Further, in this embodiment, a constitution in which the sheet S is cooled so that the temperature of the sheet S when the sheet S discharged from the fixing device 20 is stacked on the stacking tray 2 of the image forming apparatus 1, a sheet processing device or the like connected to the image forming apparatus 1 on a downstream side is less than the glass transition temperature is employed.

Here, the heat sink 81 and the upper belt 31 contact each other and slide with each other by rotation of the upper belt 31. For this reason, there is a possibility that at least one of the upper belt 31 and the heat sink 81 is abraded and thus abrasion powder generates. When the abrasion powder is gradually accumulated on a sliding surface between the heat sink 81 and the upper belt 31 by deposition thereof, there is a liability that a heat resistance between the heat sink 81 and the upper belt 31 increases and thereby a cooling performance of the sheet S passing through the upper belt 31 and the nip n lowers.

[Belt Additive]

Therefore, in this embodiment, a PTFE filler is contained as an example of a fluorine-containing resin additive in a base material made of polyimide of the upper belt 31. In this embodiment, in the polyimide resin material which is the base material, the PTFE filler is contained so as to be uniformly dispersed. A content of the FTFE filler may preferably be 0.5 weight % or more and 20 weight % or less, more preferably be 2 weight % or more and 10 weight % or less, and most preferably be 5 weight %, with respect to the base material. An average particle size of the PTFE filler may preferably be 1 μm to 100 μm, and as a shape of the PTFE filler, a spherical shape, a pulverized shape, a plate shape, a whisker shape and the like are applicable, but the spherical shape is preferable from viewpoints of surface smoothness and dispersibility. Incidentally, in this embodiment, the case where as the fluorine-containing resin additive contained in the polyimide base material of the upper belt 31, the PTFE filler is contained was described, but the fluorine-containing resin additive is not limited thereto. As the fluorine-containing resin additive, for example, FEP, PFA or the like may also be applied.

By containing the PTFE filler in the upper belt 31, friction and abrasion (wearing) between the heat sink 81 and the upper belt 31 are reduced. Further, the PTFE filler is contained in the upper belt 31 and thus the PTFE is also contained in the abrasion powder of the upper belt 31, so that there is also a function such that the abrasion powder deposits on respective members such as the heat receiving surface 83*a* of the heat sink 81 and the respective stretching rollers.

As described above, according to the cooling device 30 of this embodiment, the PTFE filler is contained in the upper belt 31, so that the friction and the abrasion between the heat receiving surface 83*a* of the heat sink 81 and the inner peripheral surface 31*a* of the upper belt 31 are reduced and thus generation of the abrasion powder can be reduced.

Further, even when an inner surface layer of the upper belt 31 is somewhat abraded, the abrasion powder itself of the upper belt 31 contains the fluorine-containing resin material such as the PTFE, and therefore, it is possible to suppress an increase in degree of the friction and abrasion between the heat receiving surface 83*a* of the heat sink 81 and the inner peripheral surface 31*a* of the upper belt 31. Further, the abrasion powder itself of the upper belt 31 contains the fluorine-containing resin material such as the PTFE, and therefore, the abrasion powder itself is not readily deposited on the respective members, so that it is possible to suppress sticking of the abrasion powder on the respective rollers contacting the inner peripheral surface 31*a* of the upper belt 31 and on the heat receiving surface 83*a* of the heat sink 81. By this, it is possible to suppress deposition of the abrasion powder, existing on the heat sink 81 or the upper belt 31, on the sliding surface between the heat sink 81 and the upper belt 31. Accordingly, an increase in heat resistance between the heat sink 81 and the sheet due to the deposition of the abrasion powder on the sliding surface between the upper belt 31 and the heat sink 81 is suppressed, so that a good cooling performance can be maintained for a long term.

Embodiment 1

Figure 4:
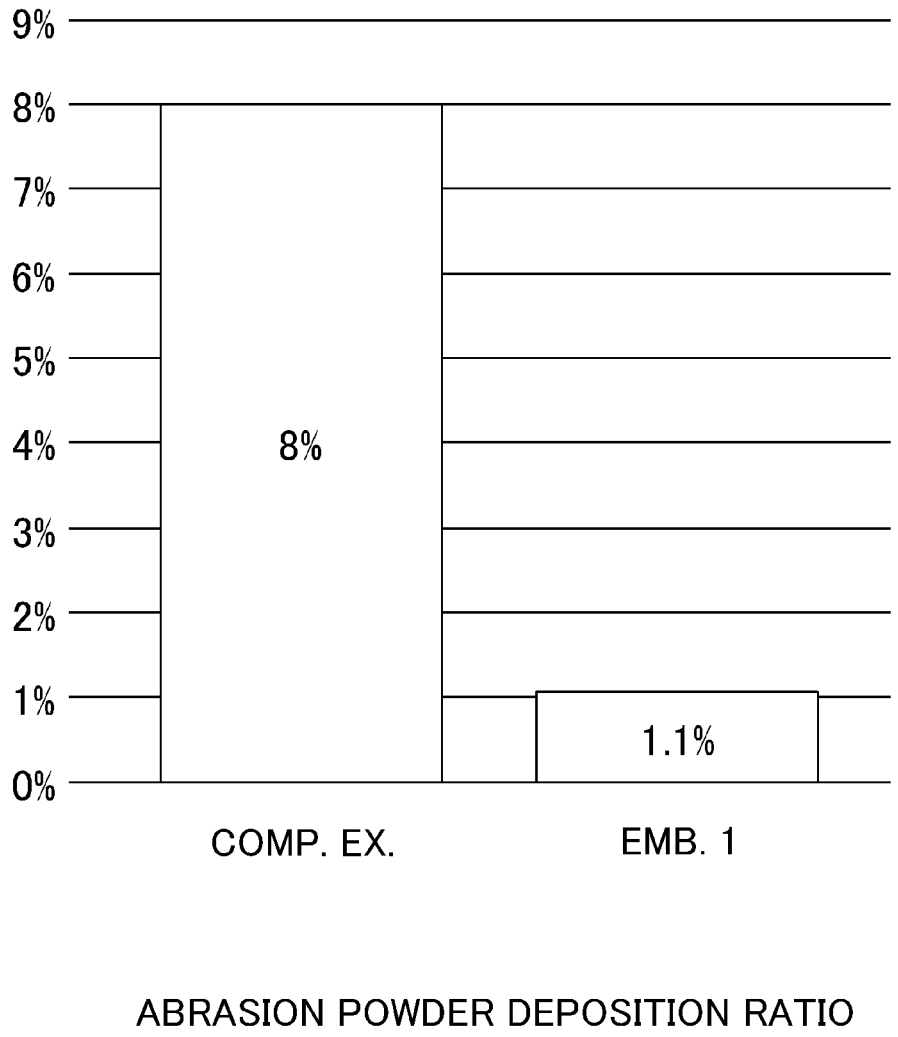
FIG. 4 is a graph showing an abrasion powder deposition ratio in a comparison example and the first embodiment.

A deposition state of the abrasion powder was measured by using the cooling device 30 of the first embodiment described above. Here, an upper belt 31 in which 5 weight % of the PTFE filler was contained in the polyimide base material was applied, and the upper belt 31 and the lower belt 32 were operated for 100 hours at their rotation speed of 500 mm/s and the sheet S was not passed through the cooling device 30 during the operation. Then, a ratio of deposition of the abrasion powder of 50 μm or more in thickness on the heat receiving surface 83*a* of the heat sink 81 when an entire surface of the heat receiving surface 83*a* is taken as 100% was measured. A result thereof is shown in FIG. 4. As shown in FIG. 4, in the case where the cooling device 30 of this embodiment was used, the deposition (ratio) of the abrasion powder was about 1.1%.

Comparison Example

As a comparison example, a deposition state of the abrasion powder was measured by using an upper belt in which the PTFE filler was not contained in the polyimide base material, and the lower belt 32 and the heat sink 81 which were described above. Similarly as in the above-described embodiment 1, the upper belt and the lower belt 32 were operated for 100 hours at their rotation speed of 500 mm/s and the sheet S was not passed through the cooling device 30 during the operation, and then the abrasion powder deposition ratio was measured similarly as in the embodiment 1. A result is shown in FIG. 4. As shown in FIG. 4, it was confirmed that the abrasion powder of 50 μm or more in thickness was deposited in a region of 8% of the entire surface of the heat receiving surface 83*a*. By this, it was confirmed that the deposition of the abrasion powder was suppressed by the cooling device 30 of this embodiment, so that it was confirmed that a good cooling performance can be stably maintained for a long term.

Second Embodiment

Figure 5:
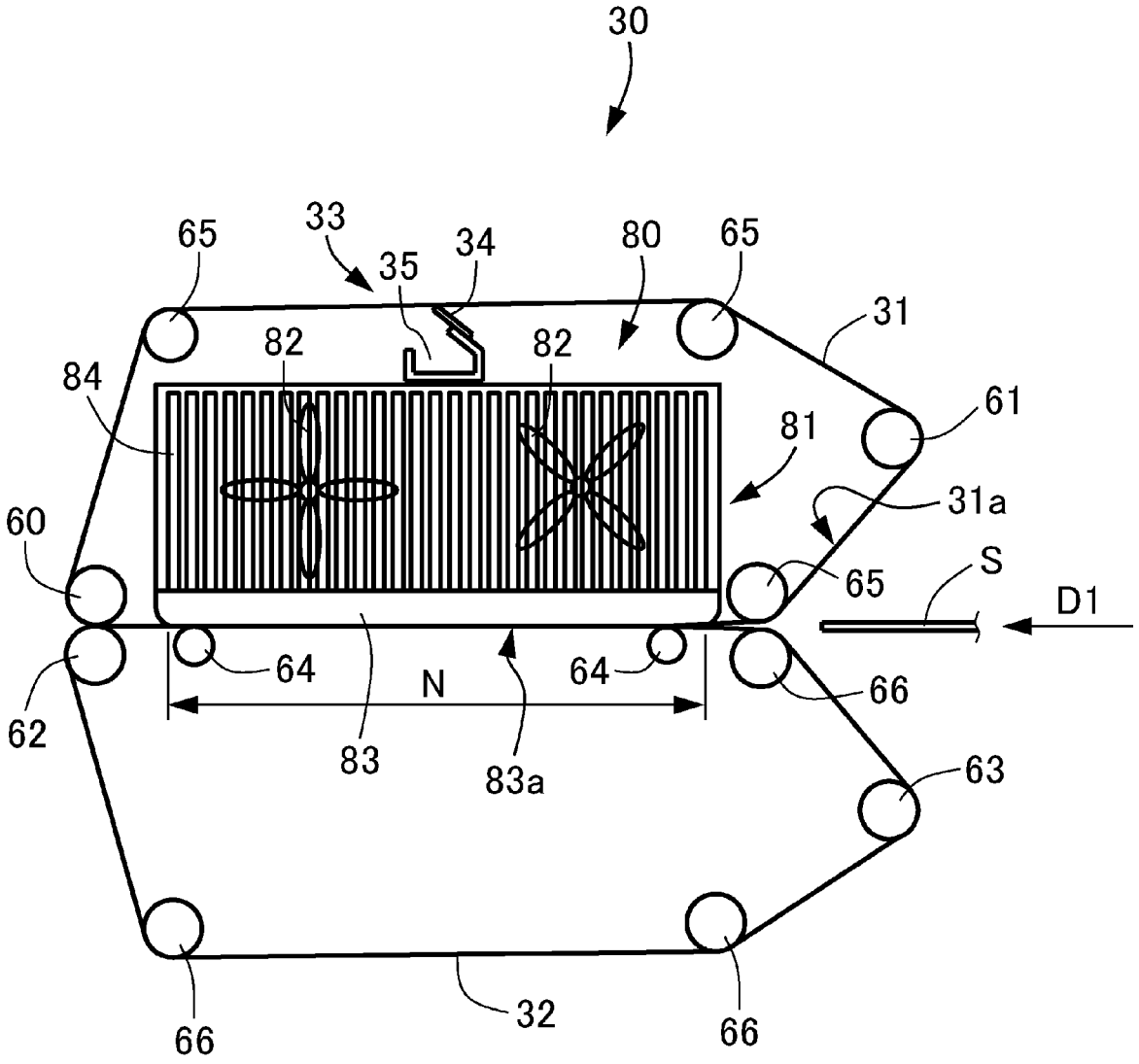
FIG. 5 is a side view showing a cooling device according to a second embodiment.

A second embodiment of the present invention will be described specifically with reference to FIG. 5. In the first embodiment, the fluorine-containing resin additive is contained in the upper belt 31 and therefore a generation amount of the abrasion powder can be remarkably alleviated, but nevertheless some abrasion powder generates, so that there is a possibility that the abrasion powder accumulates on the entirety of the heat receiving surface 83*a* of the heat sink 81 by long-term use of a cooling device 30. Therefore, in the second embodiment, a constitution thereof is different from the constitution of the first embodiment in that the cooling device 30 includes a cleaning portion (cleaning means) 33. However, other constitutions are similar to those in the first embodiment and therefore are represented by the same reference numerals or symbols and will be omitted from detailed description.

The cooling device 33 is provided on an upper portion of the upper belt 31 on an inner peripheral surface side and includes a scraper (cleaning member) 34 and a collecting box (collecting means) 35. The scraper 34 is provided for scraping off the abrasion powder of the inner peripheral surface 31*a* of the upper belt 31 and is fixed, with a double-side tape or an adhesive, on the collecting box 35 so that a free end thereof extends in a counter direction to the rotational direction of the inner peripheral surface 31*a* of the upper belt 31. That is, the scraper 34 is fixedly provided so as to contact the inner peripheral surface 31*a* of the upper belt 31. As the scraper 34, a 0.1 mm-thick PET sheet is applied, and by flexibility thereof, followability to the upper belt 31 is ensured, while slip-through of the abrasion powder is suppressed by contact of the scraper 34 with the upper belt 31 with an angle with respect to the counter direction.

The collecting box 35 is provided for collecting and storing the abrasion powder scraped off by the scraper 34 and is fixed to an unshown casing of the cooling device 30. The collecting box 35 collects the abrasion powder which is a foreign matter removed from the inner peripheral surface 31*a* of the upper belt 31 by the scraper 34. An opening of the collecting box 35 opens upward and is provided so as to extend toward a side upstream of a contact position between the scraper 34 and the upper belt 31 with respect to the rotational direction of the upper belt 31. By this, when the abrasion powder scraped off by the scraper 34 drops downward, the abrasion powder is efficiently collected by the collecting box 35.

As described above, according to the cooling device 30 of this embodiment, the cleaning portion 33 including the scraper 34 and the collecting box 35 is provided, so that the abrasion powder can be scraped off and collected. Further, even when an inner surface layer of the upper belt 31 is somewhat abraded, the abrasion powder of the upper belt 31 contains the PTFE filler, and therefore, the abrasion powder is not readily deposited on the respective members, so that it is possible to efficiently realize collection of the abrasion powder by the scraper 34. By this, it is possible to remarkably suppress deposition of the abrasion powder, existing on the heat sink 81 or the upper belt 31, on the sliding surface between the heat sink 81 and the upper belt 31. Accordingly, an increase in heat resistance between the heat sink 81 and the sheet S due to the deposition of the abrasion powder on the sliding surface between the upper belt 31 and the heat sink 81 is remarkably suppressed, so that a good cooling performance can be maintained for a long term.

Further, according to the cooling device 30 of this embodiment, there is no need that a lubricant is applied as a countermeasure against abrasion (wearing), and therefore, there is no liability that the lubricant is scraped off by the scraper 34, so that compared with a constitution in which the lubricant is applied, stable cooling performance and sliding performance can be maintained for a long term.

Embodiment 2

Figure 6:
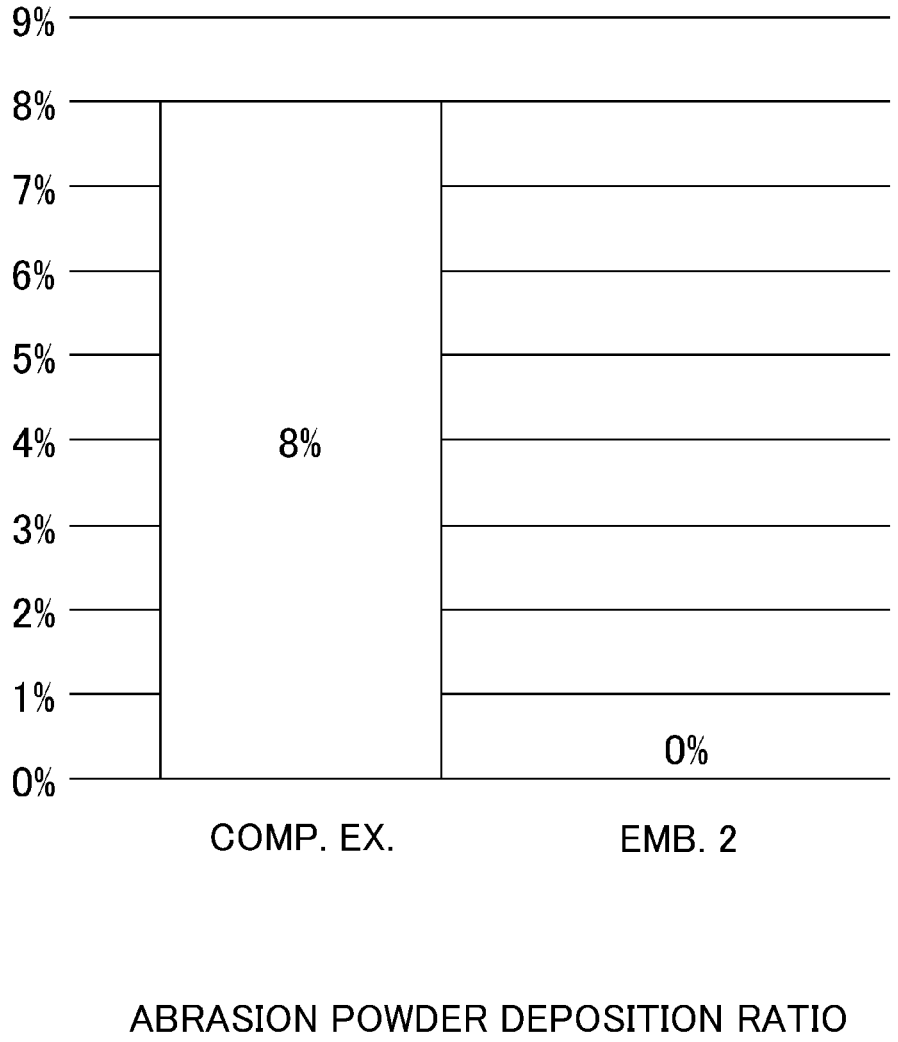
FIG. 6 is a graph showing an abrasion powder deposition ratio in a comparison example and the second embodiment.

A deposition state of the abrasion powder was measured by using the cooling device 30 of the second embodiment described above. Here, an upper belt 31 in which 5 weight % of the PTFE filler was contained in the polyimide base material, and the scraper 34 were applied, and the upper belt 31 and the lower belt 32 were operated for 100 hours at their rotation speed of 500 mm/s and the sheet S was not passed through the cooling device 30 during the operation. Then, a ratio of deposition of the abrasion powder of 50 μm or more in thickness on the heat receiving surface 83*a* of the heat sink 81 when an entire surface of the heat receiving surface 83*a* is taken as 100% was measured. A result thereof is shown in FIG. 6. As shown in FIG. 6, the deposition (ratio) of the abrasion powder was about 0%.

Comparison Example

As a comparison example, a deposition state of the abrasion powder was measured by using an upper belt in which the PTFE filler was not contained in the polyimide base material, and the lower belt 32 and the heat sink 81 which were described above and without providing the scraper. Incidentally, this comparison example is the same as the comparison example for the first embodiment. Similarly as in the above-described embodiment 2, the upper belt and the lower belt 32 were operated for 100 hours at their rotation speed of 500 mm/s and the sheet S was not passed through the cooling device 30 during the operation, and then the abrasion powder deposition ratio was measured similarly as in the embodiment 1. A result is shown in FIG. 6. As shown in FIG. 6, it was confirmed that the abrasion powder of 50 μm or more in thickness was deposited in a region of 8% of the entire surface of the heat receiving surface 83*a*. By this, it was confirmed that the deposition of the abrasion powder was remarkably suppressed by the cooling device 30 of this embodiment, so that it was confirmed that a good cooling performance can be stably maintained for a long term.

Third Embodiment

Figure 7:
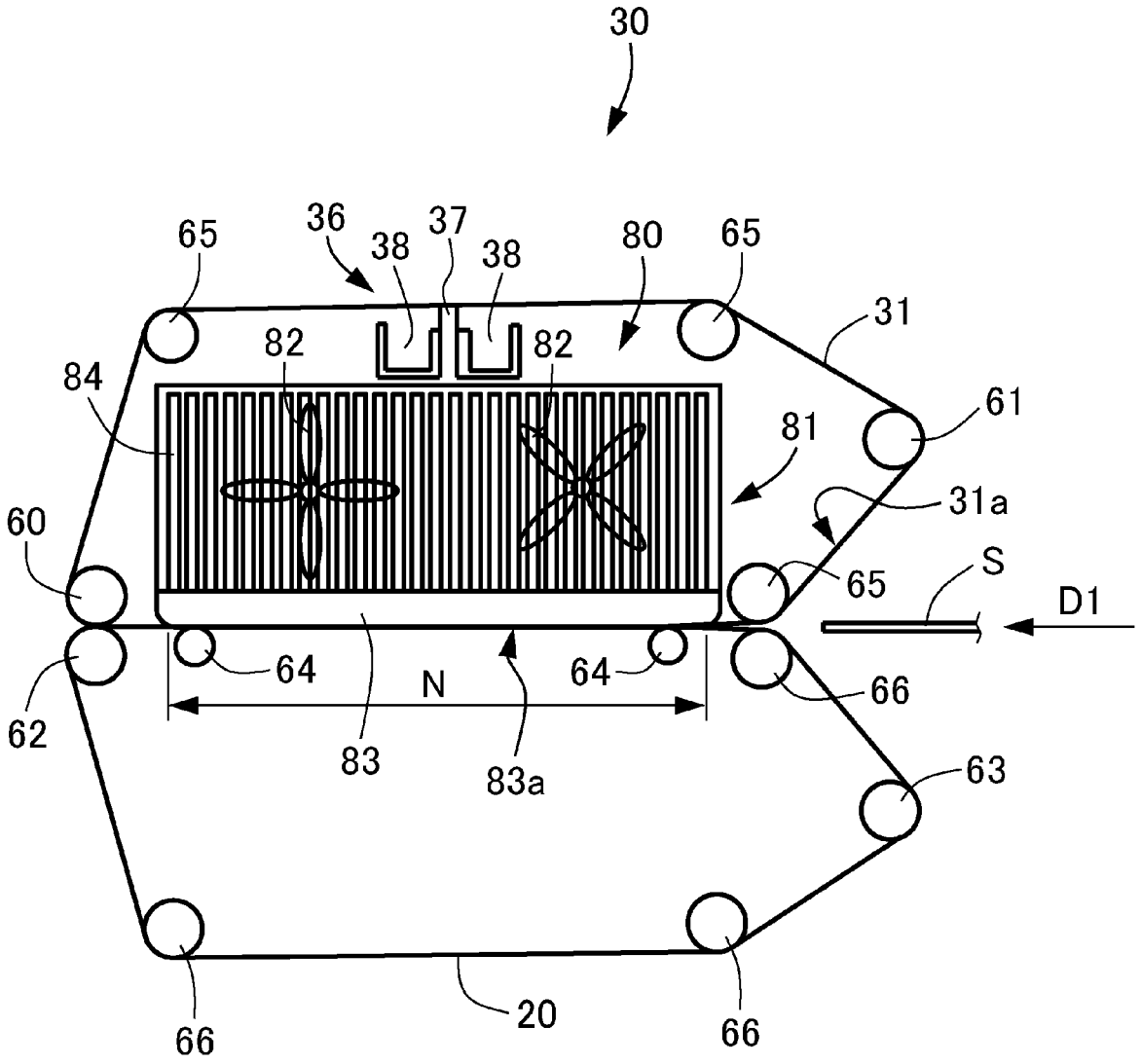
FIG. 7 is a side view showing a cooling device according to a third embodiment.

A third embodiment of the present invention will be described specifically with reference to FIG. 7. In the first embodiment, the fluorine-containing resin additive is contained in the upper belt 31 and therefore a generation amount of the abrasion powder can be remarkably alleviated, but nevertheless some abrasion powder generates, so that there is a possibility that the abrasion powder accumulates on the entirety of the heat receiving surface 83*a* of the heat sink 81 by long-term use of a cooling device 30. Therefore, in the third embodiment, a constitution thereof is different from the constitution of the first embodiment in that the cooling device 30 includes a cleaning portion (cleaning means) 36. However, other constitutions are similar to those in the first embodiment and therefore are represented by the same reference numerals or symbols and will be omitted from detailed description.

The cooling device 36 is provided on an upper portion of the upper belt 31 on an inner peripheral surface side and includes a felt (cleaning member) 37 and collecting boxes (collecting means) 38. The felt 37 is provided for scraping off the abrasion powder of the inner peripheral surface 31*a* of the upper belt 31 and is fixedly provided to the collecting boxes 38 so that a free end thereof contacts the inner peripheral surface 31*a* of the upper belt 31 with respect to the substantially vertical direction. That is, the felt 37 is fixedly provided so as to contact the inner peripheral surface 31*a* of the upper belt 31. As the felt 37, a 3 mm-thick aramid fiber strong in abrasion is applied as a material. The felt 37 has flexibility and therefore easily follows the upper belt 31, so that slip-through of the abrasion powder is suppressed. In this embodiment, the felt 37 is contacted to the upper belt 31 with respect to the vertical direction, but the present invention is not limited thereto. The felt 37 may also be provided with an arcuate angle or an obtuse angle relative to the upper belt 31 with respect to the rotational direction of the belt. In either case, the felt 37 satisfactorily follows the inner peripheral surface 31*a* of the upper belt 31, so that slip-through of the abrasion powder can be suppressed.

Each of the collecting boxes 38 is provided for collecting and storing the abrasion powder scraped off by the felt 37 and is fixed to an unshown casing of the cooling device 30. In the case where the abrasion powder is scraped off by the felt 37, there is a possibility that the scraped abrasion powder scatters from the felt 37 toward both an upstream side and a downstream side of the rotational direction of the upper belt 31. Openings of the collecting boxes 38 are provided on sides upstream and downstream of a contact position between the felt 37 and the upper belt 31 with respect to the rotational direction of the upper belt 31, and open upward. By this, when the abrasion powder scraped off by the felt 37 drops downward, the abrasion powder is efficiently collected by the collecting boxes 38.

As described above, according to the cooling device 30 of this embodiment, the cleaning portion 36 including the felt 37 and the collecting boxes 38 is provided, so that the abrasion powder can be scraped off and collected. Further, even when an inner surface layer of the upper belt 31 is somewhat abraded, the abrasion powder of the upper belt 31 contains the PTFE filler, and therefore, the abrasion powder is not readily deposited on the respective members, so that it is possible to efficiently realize collection of the abrasion powder by the felt 37. By this, it is possible to remarkably suppress deposition of the abrasion powder, existing on the heat sink 81 or the upper belt 31, on the sliding surface between the heat sink 81 and the upper belt 31. Accordingly, an increase in heat resistance between the heat sink 81 and the sheet due to the deposition of the abrasion powder on the sliding surface between the upper belt 31 and the heat sink 81 is remarkably suppressed, so that a good cooling performance can be maintained for a long term.

Fourth Embodiment

Figure 8:
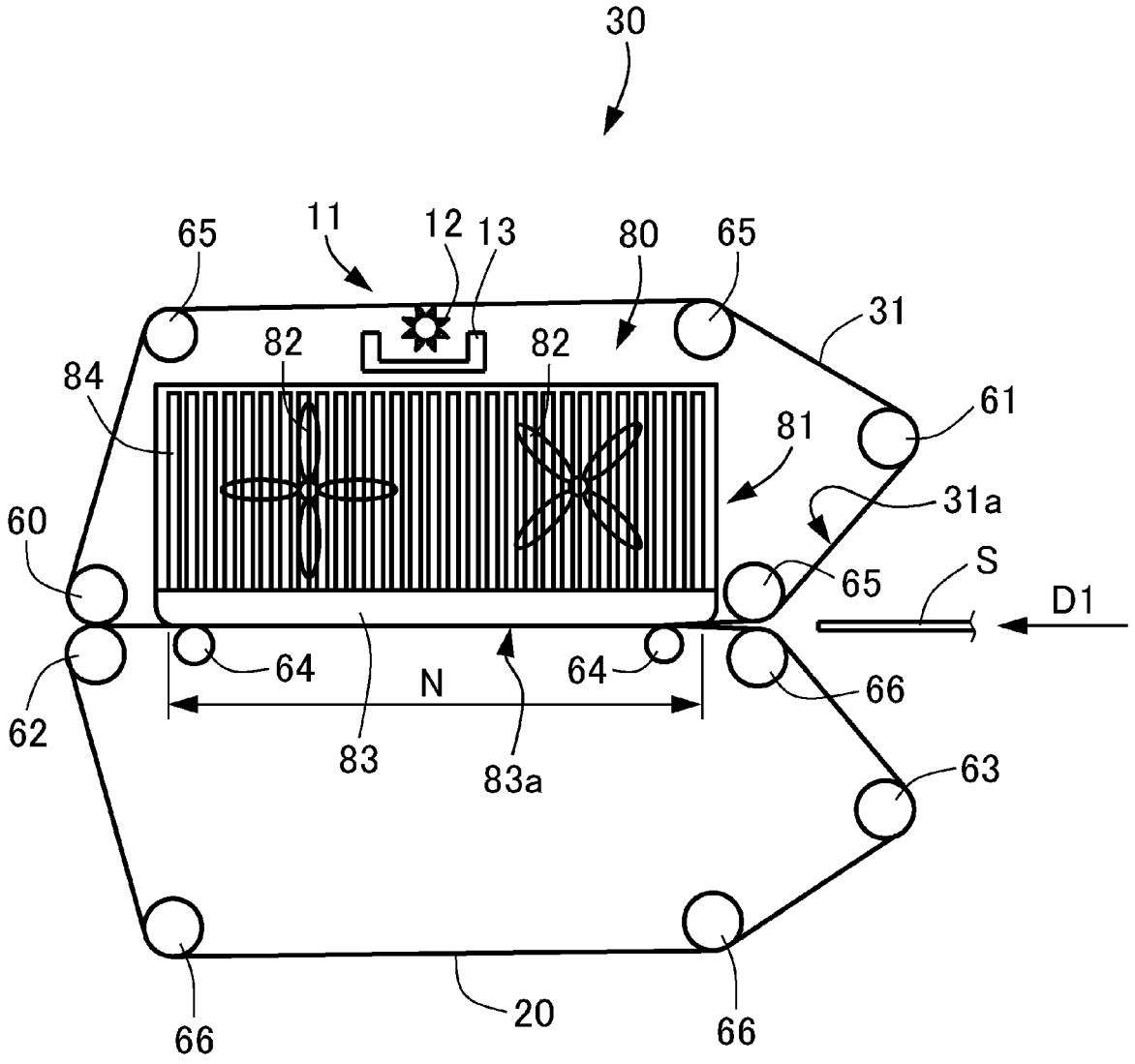
FIG. 8 is a side view showing a cooling device according to a fourth embodiment.

A fourth embodiment of the present invention will be described specifically with reference to FIG. 8. In the first embodiment, the fluorine-containing resin additive is contained in the upper belt 31 and therefore a generation amount of the abrasion powder can be remarkably alleviated, but nevertheless some abrasion powder generates, so that the abrasion powder gradually accumulates on the entirety of the heat receiving surface 83*a* of the heat sink 81 when a cooling device 30 is continuously used for a long time. Therefore, in the fourth embodiment, a constitution thereof is different from the constitution of the first embodiment in that the cooling device 30 includes a cleaning portion (cleaning means) 11. However, other constitutions are similar to those in the first embodiment and therefore are represented by the same reference numerals or symbols and will be omitted from detailed description.

The cleaning portion 11 is provided on an upper portion of the upper belt 31 on an inner peripheral surface side and includes a brush (cleaning member) 12 and a collecting box (collecting means) 13. The brush 12 is provided for scraping off the abrasion powder of the inner peripheral surface 31*a* of the upper belt 31 and is disposed so that an upper portion thereof contacts the inner peripheral surface 31*a* of the upper belt 31. The brush 12 is provided rotatably in an unshown casing of the cooling device 30 so that a direction along rotational axis directions of the driving rollers 60, 62 and the like constitutes a rotational axis, and in this embodiment, is rotated by the upper belt 31. That is, the brush 12 is rotatably provided so as to contact the inner peripheral surface 31*a* of the upper belt 31. The brush 12 is constituted by including many brush fibers on a peripheral surface of a roller-shaped core material. As the brush fibers, for example, aramid fibers each having a length of about 3 mm and a diameter of about 0.1 mm and each strong in abrasion or the like are applied as a material. The brush fibers of this brush 12 have flexibility, and therefore easily follows the upper belt 31 and thus can efficiently scrape off the abrasion powder.

The collecting box 13 is provided for collecting and storing the abrasion powder scraped off by the brush 12 and is fixed to an unshown casing of the cooling device 30. In the case where the abrasion powder is scraped off by the brush 12, there is a possibility that the scraped abrasion powder scatters from the brush 12 toward both an upstream side and a downstream side of the rotational direction of the upper belt 31. An opening of the collecting box 13 is provided on sides upstream and downstream of a contact position between the brush 12 and the upper belt 31 with respect to the rotational direction of the upper belt 31 and opens upward. By this, when the abrasion powder scraped off by the brush 12 drops downward, the abrasion powder is efficiently collected by the collecting box 13.

Incidentally, in this embodiment, the case where the brush 12 is rotated by the upper belt 31 was described, but the present invention is not limited thereto. For example, the brush 12 may be rotated by a driving source with a speed difference relative to the upper belt 31 or may also be contacted to the upper belt 31 in a rest state (rotational stop state) of the brush 12.

As described above, according to the cooling device 30 of this embodiment, the cleaning portion 11 including the brush 12 and the collecting box 13 is provided, so that the abrasion powder can be scraped off and collected. Further, even when an inner surface layer of the upper belt 31 is somewhat abraded, the abrasion powder of the upper belt 31 contains the PTFE filler, and therefore, the abrasion powder is not readily deposited on the respective members, so that it is possible to efficiently realize collection of the abrasion powder by the brush 12. By this, it is possible to remarkably suppress deposition of the abrasion powder, existing on the heat sink 81 or the upper belt 31, on the sliding surface between the heat sink 81 and the upper belt 31. Accordingly, an increase in heat resistance between the heat sink 81 and the sheet S due to the deposition of the abrasion powder on the sliding surface between the upper belt 31 and the heat sink 81 is remarkably suppressed, so that a good cooling performance can be maintained for a long term.

Fifth Embodiment

Figure 9:
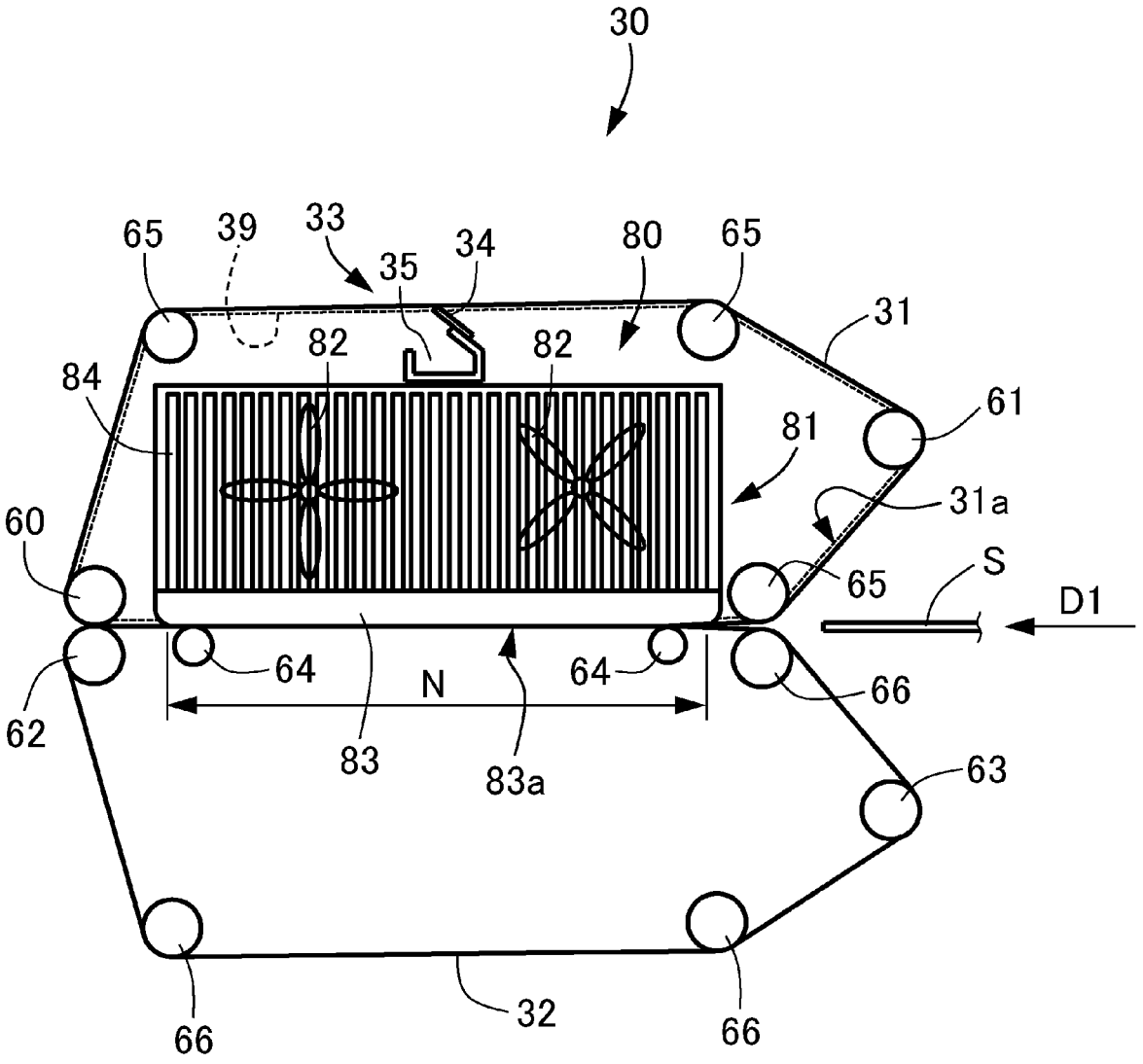
FIG. 9 is a side view showing a cooling device according to a fifth embodiment.

A fifth embodiment of the present invention will be described specifically with reference to FIG. 9. In the first embodiment, the fluorine-containing resin additive is contained in the upper belt 31, but this upper belt 31 has a structure in which as a surface layer of the inner peripheral surface 31*a*, a skin layer of polyimide having a thickness of about 1 μm-5 μm exists. The polyimide skin layer is liable to cause friction and abrasion (wearing) compared with a layer containing the PTFE filler. For this reason, in an initial stage after a start of use of the upper belt 31, some abrasion powder generates, so that there is a liability that in the initial stage, the abrasion powder gradually accumulates on an entirety of the heat receiving surface 83*a* of the heat sink 81. Therefore, in the fifth embodiment, a constitution thereof is different from the constitution of the first embodiment in that in the initial stage of the use of the upper belt 31, a solid lubricant 39 is applied onto the inner peripheral surface 31*a* and the cooling device 30 is provided with a cleaning portion (cleaning means) 33. However, the cleaning portion 33 has the structure similar to the structure of the cleaning portion 33 in the second embodiment, and other constitutions thereof are similar to those in the first embodiment, and therefore are represented by the same reference numerals or symbols and will be omitted from detailed description.

In this embodiment, before the upper belt 31 is first used or in the initial stage after the start of the use of the upper belt 31, the solid lubricant 39 is applied onto the inner peripheral surface 31*a* of the upper belt 31. As the solid lubricant 39, a quick-drying fluorine-containing powder of 5% or less in oil content is used. However, the solid lubricant 39 is not limited to the quick-drying fluorine-containing powder, but for example, even a dry lubricant or a solid lubricant 39 of another kind can achieve a similar effect. In a state in which the skin layer exists on the upper belt 31 in an initial stage of continuous (durable) use of the upper belt 31, the solid lubricant 39 applied in the initial stage reduces a degree of the friction and the abrasion at a sliding portion with the heat sink 81. In a state in which the skin layer is abraded on the upper belt 31 after the continuous use progresses, the PTFE filler contained in the upper belt 31 bleeds out to the surface layer of the inner peripheral surface 31 and thus reduces the degree of the friction and the abrasion at the sliding portion.

By using the solid lubricant 39, it is possible to not only reduce the degree of the abrasion at the heat receiving surface 83*a* of the heat sink 81 and at the inner peripheral surface 31*a* of the upper belt 31 but also suppress sticking of the abrasion powder to the respective rollers contacting the inner peripheral surface 31*a* of the upper belt 31 and to the heat receiving surface 83*a* of the heat sink 81. However, even when the solid lubricant 39 is used, there is a possibility that the abrasion powder slightly generating particularly in the initial stage of use is carried by the upper belt 31 and accumulates on a side upstream of the heat sink 81. Therefore, in this embodiment, similar to the second embodiment, the cooling device 30 is provided with the cleaning portion (cleaning means) 33. Incidentally, in this embodiment, the case where the cooling device 30 is provided with the cleaning portion 33 similarly as in the second embodiment was described, but the present invention is not limited thereto. In this embodiment, the cleaning portion 36 may also be provided similarly as in the third embodiment, and the cleaning portion 11 may also be provided similarly as in the fourth embodiment.

As described above, according to the cooling device 30 of this embodiment, the solid lubricant 39 is applied onto the upper belt 31, so that in the state in which the skin layer exists on the upper belt 31 in the initial stage of the continuous use, the solid lubricant 39 reduces the degree of the friction and the abrasion at the sliding portion with the heat sink 81. Further, the cleaning portion 33 is provided, so that the abrasion power generating even when the solid lubricant 39 is used can be abraded off the inner peripheral surface 31*a* of the upper belt 31. By this, deposition of the abrasion powder of the heat sink 81 or the upper belt 31 on the sliding surface between the heat sink 81 and the upper belt 31 can be remarkably suppressed. Accordingly, an increase in heat resistance between the heat sink 81 and the sheet S due to the deposition of the abrasion powder on the sliding surface between the heat sink 81 and the sheet S is remarkably suppressed, so that a good cooling performance can be maintained for a long term.

Other Embodiments

In the cooling devices 30 of the embodiments described above, the case where the heat sink 81 contacts the inner peripheral surface 31*a* of the upper belt 31 in the nip N was described, but the present invention is not limited thereto. For example, the heat sink 81 may also be provided so as to contact the inner peripheral surface 31*a* of the upper belt 31 at a portion other than the nip N.

Further, in the embodiments described above, the case where the cooling device 30 is incorporated in the image forming apparatus 1 was described, but the present invention is not limited thereto. For example, the cooling device 30 may also be provided as a separate member for a purpose of external addition.

According to the present invention, it is possible to suppress the lowering in cooling performance due to the deposition of the abrasion powder of the heat sink or the feeding belt on the sliding surface between the heat sink and the feeding belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-107674 filed on Jun. 10, 2019, which is hereby incorporated by reference herein in its entirety.

What is claimed is:

1. A cooling device for cooling a recording material on which a toner image is fixed, said cooling device comprising:

a first rotatable feeding belt configured to feed the recording material by rotation;

a second rotatable feeding belt configured to nip and feed the recording material in cooperation with said first feeding belt;

a heat sink contacting an inner peripheral surface of said first feeding belt; and a rotatable member, opposing said heat sink through said first feeding belt and said second feeding belt, configured to contact an inner peripheral surface of said second feeding belt, wherein said first feeding belt contains a fluorine-containing resin additive.

2. A cooling device according to claim 1, wherein said first feeding belt contains said fluorine-containing resin additive of 0.5 weight % or more and 20 weight % or less in content.

3. A cooling device according to claim 1, further comprising a fan configured to cool said heat sink by sending air to a heat dissipating portion of said heat sink.

4. A cooling device according to claim 1, further comprising a cleaning member configured to clean said first feeding belt in contact with the inner peripheral surface of said feeding belt.

5. A cooling device according to claim 4, wherein said cleaning member contacts the inner peripheral surface of said first feeding belt while rotating.

6. A cooling device according to claim 4, further comprising a collecting member configured to collect a foreign matter removed from the inner peripheral surface of said first feeding belt by said collecting member.

7. An image forming apparatus comprising:

an image forming portion configured to form a toner image on a recording material;

a fixing device including a heating member and a feeding member configured to nip and feed the recording material in cooperation with said heating member and configured to fix the toner image on the recording material by said heating member and said feeding member; and a cooling device according to claim 1, which is provided on a side downstream of said fixing device with respect to a recording material feeding direction.

8. An image forming system comprising:

an image forming portion configured to form a toner image on a recording material;

a fixing device including a heating member and a feeding member configured to nip and feed the recording material in cooperation with said heating member and configured to fix the toner image on the recording material by said heating member and said feeding member; and a cooling device according to claim 1, which is provided on a side downstream of said fixing device with respect to a recording material feeding direction.

9. A cooling device according to claim 1, wherein a PTFE filler is contained in a base material made of polyimide of said first feeding belt.

10. A cooling device according to claim 9, wherein an average particle size of the PTFE filler contained in said first feeding belt is 1 μm to 100 μm.

11. A cooling device according to claim 9, wherein a shape of the PTFE filler contained in said first feeding belt is a spherical shape.

12. A cooling device according to claim 1, wherein said rotatable member urges said first feeding belt and said second feeding belt toward said heat sink so as to contact said heat sink.

* * * * *